United States Patent [19]

Finn

[11] Patent Number: 4,583,780

[45] Date of Patent: Apr. 22, 1986

[54] CHILD'S SEAT SUNSCREEN

[76] Inventor: Cornelius B. Finn, 5830 212th St. NW., Stanwood, Wash. 98292

[21] Appl. No.: 646,797

[22] Filed: Sep. 4, 1984

[51] Int. Cl.[4] ..... A47C 7/00

[52] U.S. Cl. ..... 297/184; 24/332

[58] Field of Search ..... 297/184; 24/499, 500, 24/501, 509, 510, 329, 331, 332, 334, 338, 341, 298, 300–302; 248/558, 293, 479; 16/282, 338, 334, 340

[56] References Cited

U.S. PATENT DOCUMENTS

| | | | |
|---|---|---|---|
| 272,701 | 2/1883 | Johnson | 403/86 X |
| 424,116 | 3/1890 | Letchworth | 297/184 X |
| 2,736,027 | 2/1956 | Parmelee | 16/340 X |
| 3,258,291 | 6/1966 | Ezquerra | 297/217 |
| 4,027,915 | 6/1977 | Anderson et al. | 297/184 |
| 4,030,748 | 6/1977 | Brock | 297/184 |
| 4,279,107 | 7/1981 | Bollmann | 403/86 X |
| 4,293,162 | 10/1981 | Pap et al. | 297/184 |
| 4,314,727 | 2/1982 | Potts | 297/184 |

FOREIGN PATENT DOCUMENTS

| | | | |
|---|---|---|---|
| 425550 | 8/1948 | Italy | 24/510 |

*Primary Examiner*—William E. Lyddane
*Assistant Examiner*—José V. Chen
*Attorney, Agent, or Firm*—Christensen, O'Connor, Johnson & Kindness

[57] ABSTRACT

Disclosed is an infant seat sunscreen assembly (10) mountable on a variety of child's seat designs including automobile safety seats. A transparent, tinted flexible plastic sunscreen (12) is pivotally attached between clasps (14). The clasps have handles for easy and rapid placement or removal of the sunscreen to the child's seat. The clasps have jaw elements (16) which can be locked into position once the jaws (18) are attached to the edge of the seat. The clasps (14) can be adapted so that the sunscreen can be attached in various ways to many different car seat designs.

9 Claims, 6 Drawing Figures

Fig. 1.
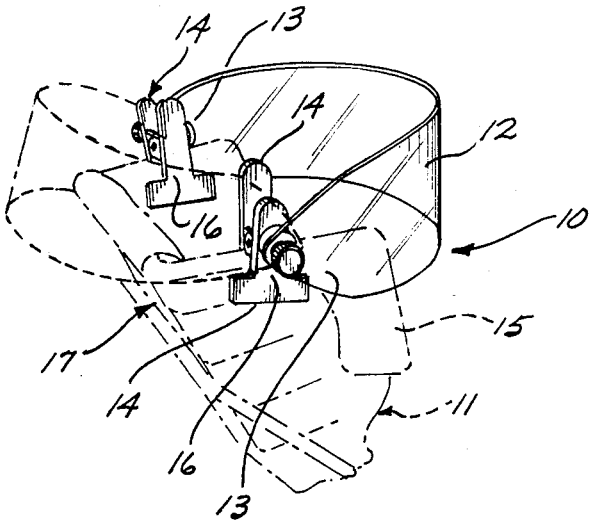
Fig. 6.
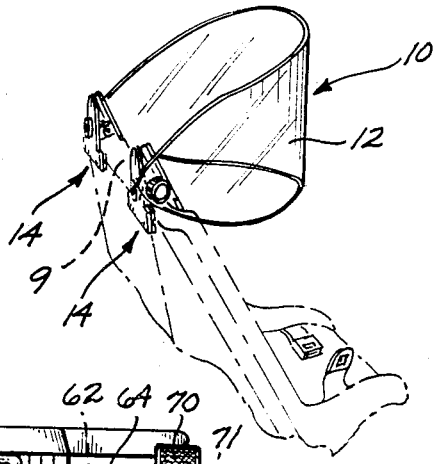
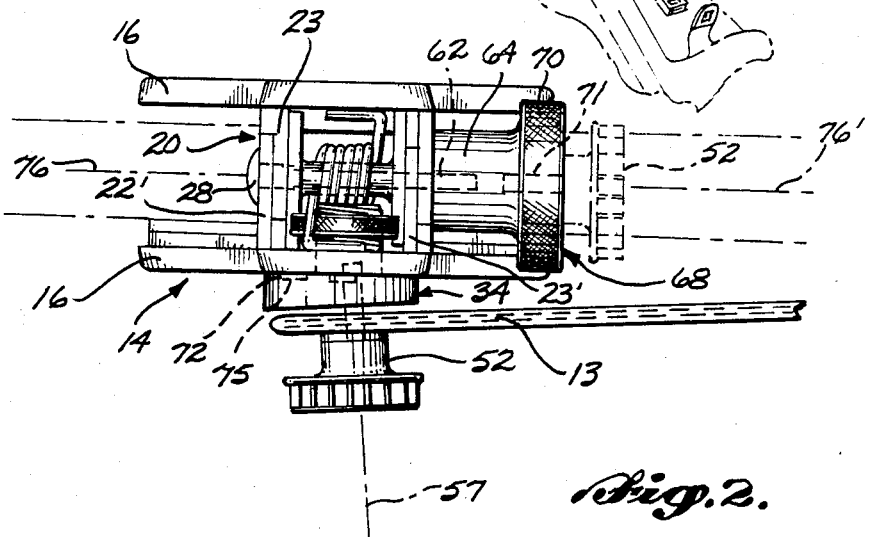
Fig. 2.

CHILD'S SEAT SUNSCREEN

BACKGROUND OF THE INVENTION

This invention relates to sunscreens or visors that can be attached to chairs or seats, in particular a sunscreen that can be used with a child's car seat.

Numerous types of automobile safety seats are available today for the safe transportation of infants and small children. The primary consideration in the design for these seats has been the safety of the child in the event of a collision or sudden stop. While a child is sitting in the car seat, it is desirable to enhance its comfort by shielding its face from sunlight without completely obstructing the child's view. Various proposals for providing shading of the infant in the car seat have resulted in designs that are specifically configured for one particular seat, or require permanent fastening devices to be fixed to the seats.

One object of this invention is to provide a variable position sunscreen that can be quickly and easily attached or removed from a child's seat. It is another object of this invention to provide a child's seat sunscreen that can be adapted to be readily attached to a variety of different child seat designs. It is still another object of this invention to provide a child's seat sunscreen that, once it is properly positioned on the seat, can be locked into that position by hand so that it will not be jarred out of position from the vibrations and jolts of the car ride.

SUMMARY OF THE INVENTION

According to the present invention, there is provided a child's seat sunscreen assembly comprising a tinted, elongated flexible sunscreen pivotally connected at its ends to clasps. The clasps include jaw elements having jaws that attach to the edge of the child's seat. The ends of the sunscreen can be selectively connected to the clasps so that they pivot about either of two axes. In the preferred embodiment, these axes are arranged so that the clasps can be attached to either the back or side edges of a car seat. The jaws are spring-biased about a hinge toward a normally closed position. Extending from the jaw elements are handle elements which, when squeezed by hand, cause the jaw elements to spread and thereby provide for engagement with the edges of the car seat. Once the sunscreen is pivoted into the appropriate position to screen the child's face from sunlight, the hinge, and thus the jaw elements, can be locked into that position to prevent the clasps from being jarred out of position by vibrations or jolts from the moving car.

BRIEF DESCRIPTION OF THE DRAWINGS

FIG. 1 is an isometric view of the child's seat sunscreen constructed in accordance with the invention and positioned on a child's car seat that has protruding side wings.

FIG. 2 is a top view of one clasp and the end portion of the sunscreen.

FIG. 6 is an isometric view of the child's seat sunscreen constructed in accordance with the invention and positioned on the top edge of an alternatively designed child's car seat.

DETAILED DESCRIPTION

Figure 3:
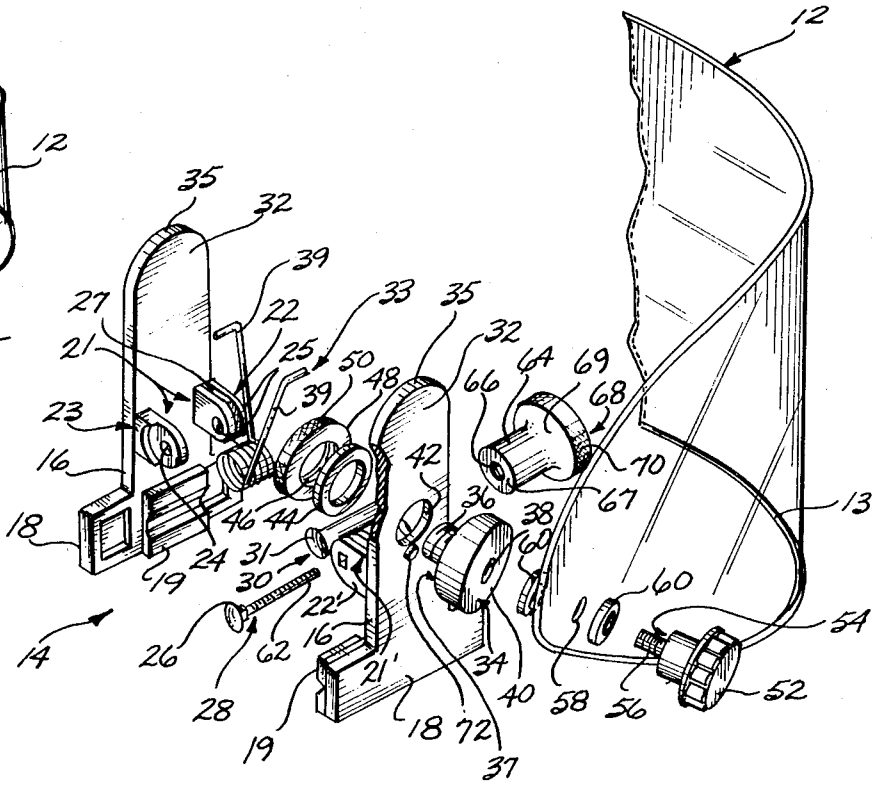
FIG. 3 is an exploded isometric view of one of the clasps and an end portion of the child's seat sunscreen.

Referring first to FIG. 1, the child's seat sunscreen assembly 10 made in accordance with the present invention is shown fastened to a child's car seat 11, shown in phantom lines. The child's seat 11 is of a relatively standard design having side wings 15 protruding forwardly from the back portion 17 of the child's seat. The sunscreen assembly 10 is fastened to seat 11 by clasps 14 that are attached to the upper edges of the side wings 15 via spring-biased jaw elements 16. A tinted, elongate flexible sunscreen 12 is pivotally attached at its ends 13 to the clasps 14 and spans across the upper front portion of the child's seat in order to intercept light rays directed at the child's face.

Referring now to FIGS. 2 and 3, each clasp 14 includes a pair of flat, T-shaped jaw elements 16 extending from a single hinge 20. The portions of the jaw elements 16 furthest from the hinge 20 form jaws 18 that comprise the crossmember of the T and thus are wider than the remaining portion of the jaw elements 16. Flat handles 32, integrally formed with the jaw elements 16 at the hinge 20, extend outwardly from the hinge 20 in a direction opposite that of jaw elements 16. The outermost edges 35 of each handle 32 is smoothly rounded to a semicircular shape. Resilient pads 19 are attached to the inner facing surfaces of the jaws 18 in order to increase the friction between the jaws and the seat edge to which they are clasped, thereby reducing slipping. It can be appreciated that the resilient pads 19 can be affixed to the jaws 18 in various arrangements while still accomplishing the antislipping function that is desired. In the preferred embodiment, one pad 19 is fixed to the central portion of the inner facing surface of the jaw 18. That pad is aligned with a space between two similar pads that are affixed to the opposing inner facing surface of jaw 18.

The hinge 20 to which the jaw elements 16 are attached is composed of first and second hinge elements 21 and 21' respectively, mounted on the inner faces of both jaw elements 16 where the jaw elements join handles 32, (FIG. 3). The first hinge element 21 has a yoke-like member 22 projecting inwardly from jaw element 16, and a flange 23 spaced apart from yoke-like member 22 and also projecting inwardly from jaw element 16. An aperture 24 passes through the flange 23 proximal to its innermost edge. The aperture axis is oriented substantially parallel to the jaws 18. Apertures 25 extend through yoke-like member 22 and are coaxial with the aperture 24 in the flange 23. The slot 27 of the yoke-like member 22 is as wide as the flange 23 is thick.

A mirror image yoke-like member 22' and flange 23' form the second hinge element 21'. When assembled, the flange 23 of a first hinge element 21 fits within the slot 27 in the opposing yoke-like member 22' of second hinge element 21', and the flange 23' of second hinge element 21' fits within the slot 27 in yoke-like member 22 of first hinge element 21. A hinge pin 28 is inserted through the aligned apertures 24 and 25 of the first and second hinge elements thereby retaining the first and second hinge elements of the opposing jaw elements 16 together and defining the axis 76 about which the jaws 18 open and close.

The hinge pin 28 passes through a substantially cylindrical sleeve 30 that has flared ends 31. Sleeve 30 extends along the length of the hinge pin between the mated flanges and yoke-like members of first and second hinge elements 21 and 21'. Sleeve 30 passes through the inside of a coiled torsion spring 33 which is also positioned between the mated flanges and yoke-like members of hinge 20. The coils of the spring 33 terminate in tangential legs 39 that extend outwardly away from the jaws 18 and press against the inner surfaces of handles 32. Squeezing the handle elements 32 together causes the jaws 18 to separate as the jaw elements 16 pivot about hinge pin 28. When the handles are released, the spring force communicated by the spring legs 39 acts against the handle elements 32 causing them to separate and thus causing the jaws 18 to close against the edge of a car seat.

Figure 5:
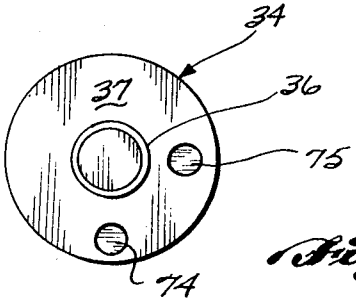
FIG. 5 is an end view of the first boss of the clasp.

A significant advantage of the sunscreen assembly made in accordance with the invention resides in the adaptability of the clasp 14 so that the sunscreen 12 can be connected to the clasp in either of two orientations. FIGS. 2 and 3 show the end 13 of the sunscreen 12 pivotally connected to the clasp 14 in one of the available orientations. A substantially cylindrical first boss 34 is secured to one handle 32 of the clasp 14. The first boss 34 has an inner planar surface 37 and an outer planar surface 40. Protruding from the inner planar surface 37 is a threaded extension 36 which passes through an aperture 42 in handle 32 and mates with a nut 48. Nut 48 has a knurled edge 50 so that it can be easily hand tightened. A washer 44 is positioned between the nut 48 and the handle 32. Hand tightening of the nut 48 secures the inner planar surface 37 of first boss 34 against the handle 32. A cylindrical detent peg 72 is attached to the outer surface of the handle 32. When the first boss 34 is secured to handle 32, detent peg 72 extends into a corresponding cylindrical recess 74 (FIG. 5) formed in the inner planar surface 37 of the first boss 34. The significance of the recess 74 is explained in more detail below. The detent peg 72 and recess 74 prevent the first boss 34 from rotating, and thereby loosening, as the sunscreen 12 is moved up and down.

In the orientation illustrated in FIGS. 2 and 3 the sunscreen 12 is fastened at its end 13 to the outer planar surface 40 of the first boss 34. The end 13 of the sunscreen is positioned between the outer planar surface 40 of the first boss 34 and a planar face 54 of a fastening knob 52. Extending from the planar face 54 of the fastening knob 52 is a threaded shaft 56 which passes through resilient washers 60 that are positioned on each side of an aperture 58 in the sunscreen end 13. The threaded shaft 56 mates with a threaded aperture 38 that extends through the planar surface 40 of the first boss 34. Rotation of the fastening knob 52 causes the planar face 54 of the knob to be drawn against a washer 60 toward the planar surface 40 of the first boss. The knob can be adjustably tightened to an extent that it will securely hold the sunscreen 12 in position between the knob 52 and first boss 34 but still allow it to be pivoted when force is applied by hand to the sunscreen.

The central axis of threaded shaft 56, when it is positioned in the threaded aperture 38, forms a first connection axis 57 (FIG. 2). It is about this axis 57 that the sunscreen 12 pivots. Thus, when the sunscreen is mounted on a child's seat of a design as shown in FIG. 1 (i.e., with side wings extending from the back portion of the seat), the sunscreen is pivotable about the axis 57 that is approximately orthogonal to the axis 76 of the hinge pin 28 (FIG. 2).

If the clasps 14 were to be attached to the top back portion of a child's seat having no side wings, as shown in FIG. 6, the hinge pins 28, and thus axis 76, of both clasps 14 will be in a coaxial relationship. When the clasps are so positioned, it is about this hinge pin axis 76 that the sunscreen must pivot in order to function properly. The child's seat sunscreen made in accordance with this invention provides clasps 14 that can be adapted to permit the sunscreen 12 to be connected to the clasps so that the sunscreen can pivot not only about an axis that is approximately orthogonal to the hinge pin axis 76 (as previously described), but also an axis that is substantially coaxial with the hinge pin axis 76 (as described next). Having such adaptability, the sunscreen 12 is usable with a variety of car seat designs.

In order to provide this adaptability, an additional connection means is utilized. Specifically, with reference to FIGS. 2 and 3, a substantially cylindrical second boss 64 having an inner planar surface 67 and an outer planar surface 68 is secured to the clasps 14. A threaded aperture 66 extends orthogonally through the inner planar surface 67 along the longitudinal axis of the second boss 64. An extension 62 of the hinge pin 28 protrudes from hinge 20 and mates with aperture 66 in second boss 64. The outer end portion 69 of the second boss 64 is flared to form a circumferential protrusion with a knurled surface 70. The second boss 64 is secured to the clasp by rotating the outer end portion 69 by hand and drawing inner planar surface 67 against the hinge 20. Hinge pin 28 utilizes a carriage bolt design whereby the square neck portion 26 seats into the correspondingly shaped outermost aperture 25 in the hinge element 21', thereby preventing rotation of the hinge pin while the second boss 64 is being secured to the hinge.

The sunscreen 12 is mountable to the outer planar surface 68 of the second boss 64 by utilizing the fastening knob 52 to thread shaft 56 through the sunscreen aperture 53 and into a threaded aperture 71 that extends through the outer planar surface 68 of the second boss 64 along its longitudinal axis. When the fastening knob 52 is used to connect the sunscreen 12 to the second boss 64, the threaded shaft 56 (about which the sunscreen pivots) defines an axis 76' (FIG. 2) that is coaxial with the axis 76 of the hinge pine 28. When the sunscreen 12 is connected to the clasps 14 as just described, the sunscreen assembly 10 can then be attached to the upper back edge 9 of a car seat of the type shown in FIG. 6.

Another important function of the second boss 64 is to prevent unwanted opening of the jaws 18 once they have been positioned on the edge of a car seat. This locking function is simply accomplished by further clockwise rotation of the second boss 64 about its longitudinal axis. As the head of the hinge pin 28 and the inner planar surface 67 of the second boss 64 are drawn together because of this rotation, the yoke-like members (22, 22') and flanges (23, 23') of the juxtaposed first and second hinge elements 21 and 21' will be pressed tightly together thereby locking the hinge 20 (and thus the jaws 18) in place. When it is desired to relocate the clasps 14, the second boss 64 can be rotated counterclockwise to loosen the hinge elements thereby allowing the hinge 20 to operate normally.

When sunscreen 12 is secured at its ends 13 to the second boss 64 and clamped to a seat as shown in FIG. 6, the outer planar surfaces 68 of each second boss 64 of each clasp 14 are substantially parallel. This parallel relationship is most favorable for smooth, nonbending rotation of the sunscreen ends 13 about the shaft 56 of fastening knob 56. In most car seat designs that incorporate side wings, the side wings do not extend truly orthogonal from the back of the car seat, that is, the angle between the side wings and the back of the car seat is usually slightly greater than 90°. Thus, clasps 14 mounted to the top edge of these side wings, as shown in FIG. 1, will not be parallel to each other. To minimize any binding effect on the pivotable sunscreen 12 when it is so mounted (i.e., with the sunscreen ends 13 fastened to the planar surface 40 of the first boss 34), the first boss 34 is formed with its outer planar surface 40 and threaded aperture 38 inclined with respect to its inner planar surface 37. The first boss 34, of each clasp 14 is secured to the handle 32 in such a way that the inclined outer planar surface 40 of each first boss 34 will be substantially parallel when the clasps are mounted to the tops of slightly diverging car seat side wings 15 as shown in FIG. 1. When the first boss is so positioned, the cylindrical recess 74 (FIG. 5) that is formed in the planar surface 37 of the first boss, mates with the cylindrical detent peg 72.

Figure 4:
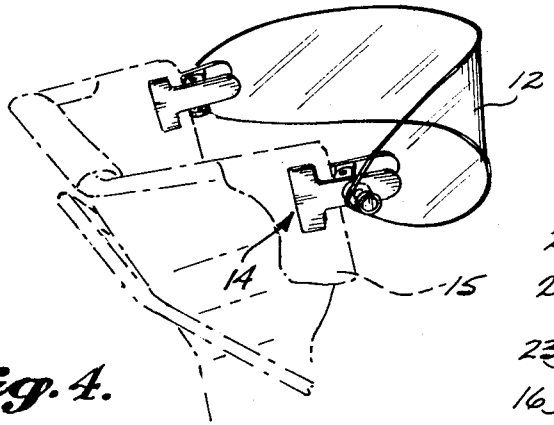
FIG. 4 is an isometric view of the sunscreen clasped, in an alternative manner, to the child's car seat of FIG. 1.

After loosening the first boss 64 from the handle 32, a 90° counterclockwise rotation of the first boss 34 aligns the detent peg 72 with the other cylindrical recess 75 in the inner planar surface 37 of first boss 34. When the first boss is secured to handle 32 in this position, the outer planar surface 40 is inclined toward the outer end 35 of the handle 32, resulting in the favored parallel relationship of each outer planar surface 40 when the clasps are mounted to the side edges of the side wings 15 of the car seat shown in FIG. 4.

It can be seen that the combination of the above-described clasps and the sunscreen provide a simple, versatile, and relatively inexpensive way of modifying a child's seat, especially an automobile safety seat, for screening the sun from the child's face. The transparent nature of the sunscreen allows the child to view its surroundings while also allowing the attending adult to maintain a view of the child's face.

It is not uncommon for an infant to use more than one size or shape of automobile safety seats as it grows from infancy to childhood. Also, babysitters, relatives, etc., may utilize automobile safety seats that are designed differently than that of the parents. It can be appreciated that the variable opening jaws of the clasp of applicant's invention, along with its adaptable connectors will permit one sunscreen to be mounted on a large variety of designs of safety seats.

It will be understood that various changes in the details, materials and configuration of the child's seat sunscreen which has been herein described and illustrated in order to explain the nature of the invention may be made by those skilled in the art within the principal and scope of the invention as expressed in the appended claims.

The embodiments of the invention in which an exclusive property or privilege is claimed are defined as follows:

1. An apparatus attachable to a child's seat for screening sunlight from the face of a seated child, comprising:

a tinted, elongated, flexible sunscreen having substantially flat ends;

a pair of clasps, each clasp having a pair of jaw elements, the jaw elements forming jaws for clasping an edge of the child's seat;

each clasp including first connection means for pivotally connecting an end of the sunscreen to said clasp, the sunscreen being pivotable about a first connection axis when connected to said clasp by the first connection means;

each clasp further including second connection means for pivotally connecting the sunscreen to said clasp, the sunscreen being pivotable about a second connection axis when connected to said clasp by the second connection means, the first and second connection axes being substantially perpendicular to one another.

2. The apparatus of claim 1, wherein the first connection means includes:

a first boss fastened to each clasp, the first boss having a planar surface; and a fastener knob having a planar face; the first connection means also including a shaft attached to the fastener knob and projecting through the planar face of the fastener knob, the projecting portion of the shaft being engageable with the first boss to fasten the fastener knob to the first boss with the planar face of the fastener knob in substantially abutting relationship with the planar surface of the first boss, the shaft defining the first connection axis when the fastener knob is fastened against the first boss, the ends of the sunscreen being securable between the planar surface of the first boss and the planar face of the fastening knob of each clasp such that each end of the sunscreen is pivotal about the first connection axis.

3. The apparatus of claim 2, wherein the second connection means includes a second boss fastened to each clasp, the second boss having a planar surface, the shaft of said fastener knob being engageable with the second boss to fasten the fastener knob to the second boss with the planar face of the fastener knob in substantially abutting relationship with the planar surface of the second boss, the second connection axis being defined by the shaft when the fastener knob is fastened against the planar surface of the second boss, the ends of the sunscreen being securable between the planar surface of the second boss and the planar face of the fastener knob of each clasp such that each end of the sunscreen is pivotable about the second connection axis.

4. The apparatus of claim 3, wherein the jaw elements of each clasp are joined together at one end by a hinge, the hinge having a hinge pin about which the jaw elements pivot to open and close the jaws, the hinge also having at least one hinge element extending from each jaw element, the hinge pin passing through the hinge elements, the hinge elements arranged in side-by-side relationship to move in slidable contact relative to each other about the hinge pin as the jaws are opened and closed; and locking means for preventing movement of the hinge at any selected position of the jaws.

5. The apparatus of claim 4, wherein the locking means includes an extension of the hinge pin beyond the hinge to engage the second boss, the engaging portion of the hinge pin being threaded so that rotation of the second boss about the hinge pin draws the second boss towards the hinge thereby pressing the hinge elements together to prevent their movement.

6. The apparatus of claim 5, further comprising a pair of handle elements extending from the hinged ends of the jaw elements, the handle elements being spring biased so that the jaws tend toward the closed position, the jaws openable when the handle elements are brought toward each other.

7. The apparatus of claim 6, wherein resilient washers are positioned adjacent to the planar surfaces of the first and second bosses and the planar face of the fastener knob, the fastener knob being adjustable against the resilient washer so that the sunscreen will be held in place once it is pivoted into the desired position.

8. The apparatus of claim 2, wherein the first boss can be fastened to clasp in variable positions so that the inclination of the planar surface of the first boss will vary with respect to the clasp for each selected position.

9. The apparatus of claim 8, further comprising detent peg integrally formed with the clasp, the detent peg engageable with a correspondingly-shaped recess formed in the first boss, the detent peg and recess configured and arranged to prevent rotation of the first boss with respect to the clasp.

* * * * *

UNITED STATES PATENT AND TRADEMARK OFFICE

CERTIFICATE OF CORRECTION

PATENT NO. : 4,583,780

DATED : April 22, 1986

INVENTOR(S) : Cornelius B. Finn

It is certified that error appears in the above-identified patent and that said Letters Patent is hereby corrected as shown below:

Column 8, line 3, insert --a-- before "detent".

Signed and Sealed this

Twenty-eighth Day of October, 1986

[SEAL]

*Attest:*

DONALD J. QUIGG

*Attesting Officer*

*Commissioner of Patents and Trademarks*